US007338142B2

(12) United States Patent
Nii et al.

(10) Patent No.: US 7,338,142 B2
(45) Date of Patent: Mar. 4, 2008

(54) SHELVING UNIT AND REFRIGERATOR HAVING THE SAME

(75) Inventors: Kunio Nii, Osaka (JP); Tomoyasu Saeki, Osaka (JP); Toshimasa Imaizumi, Osaka (JP); Makoto Oikawa, Osaka (JP); Kazuaki Gono, Osaka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 405 days.

(21) Appl. No.: 10/512,556

(22) PCT Filed: Apr. 18, 2003

(86) PCT No.: PCT/JP03/05025

§ 371 (c)(1),
(2), (4) Date: May 5, 2005

(87) PCT Pub. No.: WO03/091643

PCT Pub. Date: Nov. 6, 2003

(65) Prior Publication Data

US 2005/0223731 A1 Oct. 13, 2005

(30) Foreign Application Priority Data

Apr. 25, 2002 (JP) ..... 2002-124799
Jul. 23, 2002 (JP) ..... 2002-214431
Aug. 28, 2002 (JP) ..... 2002-248459

(51) Int. Cl.
*A47B 96/02* (2006.01)

(52) U.S. Cl. ..... 312/408; 312/323

(58) Field of Classification Search ..... 312/401, 312/408, 410, 322, 323, 294, 319.1; 62/298, 62/377, 441

See application file for complete search history.

(56) References Cited

U.S. PATENT DOCUMENTS 2,648,516 A * 8/1953 Manetti et al. ..... 248/311.2
2,926,507 A 3/1960 Ingolia
3,460,876 A * 8/1969 Boer ..... 312/246
5,348,207 A * 9/1994 Frank ..... 224/310
5,957,558 A * 9/1999 Quade ..... 312/323

FOREIGN PATENT DOCUMENTS

| | | |
|---|---|---|
| JP | 60-65592 | 5/1985 |
| JP | 4-19232 | 2/1992 |
| JP | 06-101960 | 4/1994 |
| JP | 07-184725 | 7/1995 |
| JP | 2001-133110 | 5/2001 |
| JP | 2001-280830 | 10/2001 |

* cited by examiner

*Primary Examiner*—James O. Hansen
(74) *Attorney, Agent, or Firm*—Oblon, Spivak, McClelland, Maier & Neustadt, P.C.

(57) ABSTRACT

A height of a rack container or shelf is shiftable with an easy procedure and slight effort, to improve user friendliness even when disposed at quite a height from the floor within a storage chamber or compartment. An adverse effect on a downward adjacent shelf is avoided to improve or retain actually usable volume on the adjacent shelf. A rack apparatus or a refrigerator includes stationary rails, a traveling rail, arms hinged on a traveling rail to be turnable in one way or other, a rack support connecting the arms, and a rack container supported on the rack support. The rack container can be shifted forward by the traveling rail and be shifted upward and downward with keeping its horizontal posture, by turning of the arms.

25 Claims, 15 Drawing Sheets

SHELVING UNIT AND REFRIGERATOR HAVING THE SAME

BACKGROUND OF THE INVENTION

This invention relates to rack apparatuses for shelves or containers receiving foods in a refrigerator, or for cupboards or cabinets in kitchen, warehouse or the like. In particular, the invention relates to rack apparatuses that enable shifting of receiving position to back and fore or to up and down.

In these years, refrigerators or kitchen cupboards for example are in a trend of becoming larger with respect to internal volume, in connection with diversification of dietary pattern. Especially in refrigerators for households, jumbo ones having over-400-liter internal volume are of mainstream; which have external height of about 180 cm along with larger and larger sizes in width and depth.

Concurrent with this, internal volume of each compartment, such as a fresh food compartment or a vegetable compartment becomes larger and larger. FIG. 19 shows an arrangement of the compartments in a refrigerator; at upper part of the refrigerator is disposed a fresh food compartment (52) of large internal storage volume and being most frequently used; and disposed therebelow are a vegetable compartment (53) and a freezer compartment (54). The fresh food compartment (52) is equipped with a door (56) that is hinged at right or left side of a front opening of the compartment as to close up the front opening freely openable and re-closable. The vegetable compartment (53) and the freezer compartment (54) are in a form of drawer container that is attached on inside of respective door, in consideration of easiness of taking items into and from the compartments. In the fresh food compartment (52), shelves (55) are disposed as to partition the compartment into several stages or stories and as to receive food items on each shelf or rack opening.

Highest one of the shelves (55) is located at height of about 160 cm from room floor and depth of that shelf is large; when external height of the refrigerator is about 180 cm and the fresh food compartment (52) is disposed at upper part of the refrigerator as mentioned before. Thus, for the persons of short stature, job of taking food items into and from rack opening on the highest shelf is troublesome; and moreover, it is rather hard job to look into how the items are stored on the highest shelf, in particular, to utilize back side part on the highest shelf.

In view of this, there is proposed a following construction of the shelves: highest shelf is formed of fore and back pieces, which are to be superimposed with each other at back side; such superimposing is made when difficulty for utilizing the back side portion being arisen due to presence of fore part of the highest shelf; in this manner, it is facilitated reaching of hand of the person to the back side portion. Meanwhile, JP-2001-50648A (Unexamined patent publication of Japan No. 2001-50648) proposes a construction of shelves in which height of a shelf other than the highest one is freely adjustable.

When the highest shelf is formed of such back and fore pieces, area for receiving the food items is reduced by half if to achieve enough easiness to utilize the shelf. Meanwhile, in a construction proposed in JP-2001-50648A, such height-adjustable shelf may come to contact with items on a downward adjacent shelf and to impair storing on the downward adjacent shelf when the height-adjustable shelf is shifted downward.

In view of the above problems, this is to facilitate easiness in utilizing of a shelf or rack opening at a quite height within an internal storing volume, by enabling upward and downward shift of the shelf or a container with easy and slight job of the user; and it is in same time to eliminate interference to the items on the downward adjacent shelf as to achieve high utilization ratio of the internal storing volume.

SUMMARY OF THE INVENTION

According to one aspect of the invention-wise rack apparatus, said rack apparatus comprising: stationary rails attached on side walls of receiving space; traveling rails horizontally sliding on the stationary rails; arms hinged on the traveling rails as to turn around one way or other; a stopper having an arc-shaped linkage groove and being hinged on the traveling rail as to be freely turnable; a protrusion formed on the stopper in vicinity of such hinged portion, the protrusion being engaged with the stationary rail to block downward turning of the stopper during sliding on the stationary rails and then leaving out from an end of the stationary rail to allow downward turning of the stopper; a guide pin protruding from the arm to engage with the linkage groove, and being shifted to a lowermost position of the linkage groove to allow downward turn-wise shifting of a distal end of the arm in accordance with downward turning of the stopper; a rack support connecting the arms; and a rack container supported on the rack support; said rack container being able to be shifted forward by the traveling rail and then be shifted downward and upward with keeping its horizontal posture, by turning of the arms.

By such arrangement, followings are accomplished; a rack container that is shiftable horizontally and vertically in a reliable manner with simple procedure; improved user friendliness and easiness in taking the items into and from the rack container even if it is at a quite height under normal state; and efficient usage of the internal space of the storage compartment or receiving part.

Preferably, said arms has hinged portions at their underside base portions and hold the rack support and the rack container at upside distal portions of the arms, so as to be downwardly turnable about the hinged portions. More preferably, the rack apparatus is further comprised of a spring at the hinged portion as to exert spring force for facilitating upward and backward turning of the arms.

By such construction, the height-wise dimension for shifting range of the rack container is made large, for distal ends of the arms become lowermost from uppermost by downward turning of the arms; and the arms do not protrude into upside of the rack container as to omit space not usable for storage of the items. Further, if the spring is used, abrupt downward shifting of the rack container is averted by requiring an adequate pulling down force; and in same time, heaving of the rack container is made by small muscle force even when the items on the container are large in quantity and are thus heavy.

Still more preferably, the rack apparatus further comprising a damper on an outer face of the arm for abutting on the traveling rail in accordance with turning motion of the arm as to stop downward shifting of the rack container the spring force of said spring being smaller than shock-absorbing force of said damper. By this construction, for downward shifting of the container, no substantial muscle force is needed when load is substantially nil; and abrupt descending of the rack container is prevented when load is heavy.

In a preferred embodiment, fore arm and rear arm are hinged on a base-part surface of the traveling rail at spaced-apart positions and as to be freely turnable; distal ends of the fore and rear arms are hinged on the rack support at two neighboring positions respectively and are thereby connected with each other. By this construction, shifting of the rack container in horizontal and vertical directions is made reliably.

In a preferred embodiment, the rack container is held on supporting portion of the rack support by use of a rack fastener in a manner as detachable and re-attachable. Preferrably, the rack fastener is engaged on latching portion of the rack support as tunrnable in one way or the other; and the rack fastener is latched on the rack container by way of engagement between a protrusion and a recess or hole, in a manner that the rack container is detachable and re-attachable onto the rack support. By such construction, the rack container is easily detachable and re-attachable, and thereby, cleaning or repairing is easy. Further, loss or missing of the fastener is averted because the fastener remains on the rack support after detaching of the rack container.

In a preferred embodiment, the rack container further comprises a reinforcing frame that is attached on the rack supports on right-hand and left-hand sides and thrusts forward as to engage with and receive front fringe of the rack container. By such construction, reinforcement for the rack container and for its supporting structure is easily made without forming a reinforcing structure in the rack container itself.

In a preferred embodiment, the rack container further comprises a rear frame that connects the arms on right-hand and left-hand sides and is disposed to be backside of the rack container at its rear-upside retracted position. By such construction, avoided are; hampering of turning motion of the mechanism for holding the rack container; and interfering with motion for taking out food items on the rack container when the rack container is turned fore-under-side position.

In a preferred embodiment, the rack container further comprises a rack opening's guard at an opening of the rack container; and a guard part of the rack opening's guard being shiftable between a position at upside of the rack container and a position at foreside of the rack container. By such construction, beverage cans or the like are prevented from turning flat or dropping out when the guard part is on foreside; and procedure of taking the items away and into the rack container is facilitated when the guard part is on upside as to open up foreside. Further, the guard part may be used as gauge for acceptable height of the items to be accommodated in order for avoiding contact between the items and ceiling of the storage compartment or the like.

In a preferred embodiment, front face of the rack container is formed as rounded to bulge out from its center portion. By such construction, avoided is interfering between the front face portion of the rack container and the inward pockets on the door when the door is opened by around 90°. Further, when the door is closed while the rack container is at pulled-down positions, shock of collision is alleviated. Moreover, ornamental appearance is improved.

According to another aspect of the invention-wise rack apparatus, said rack apparatus comprised of a rack container that is disposed in a storage compartment or chamber of a refrigerator and that is to be shifted forward and then downward as to be kept at such downward shifted position by rack mechanism; and at the downward shifted position, the bottom face of the rack container being at height of 140 to 155 cm from floor surface on which main body of the refrigerator stands. By such arrangement, the height of the bottom face is set to agree with that of the eye line of the average-stature women. In this way, the food items on the rack container are fully visible and easy to be taken in and out.

According to still another aspect of the invention-wise rack apparatus, said rack apparatus comprised of a rack container that is disposed in a storage compartment or chamber of a refrigerator and that is to be shifted forward and then downward as to be kept at such downward shifted position by rack mechanism; and at the downward shifted position, rear part of the rack container being forwardly distanced from fore end of a downward adjacent shelf to form a certain clearance for avoiding interference between them. By such arrangement, interference between the rear part of the rack container and the front face of the downward adjacent shelf is averted; and fingers of the hand, which for example grabs the downward adjacent shelf for supporting, are prevented from being pinched between the rack container that moves downward and the downward adjacent shelf.

According to further aspect of the invention-wise rack apparatus, said rack apparatus comprising: a rack container that is disposed at predetermined height with respect to side walls of a receiving space; and means for downwardly shifting the rack container after pulling forward the rack container; and bottom face of the rack container being inclined to be raised forwardly. By such arrangement, when the rack container receives strong shock from foreword, the rack container, more specifically fore part of the rack container is raised to upwardly dissipate some load, which would have been directly received by the rack container in otherwise. Thus, load applied on hinged portions is suppressed to minimum possible, and rupture of the rack container is avoided.

According to the invention-wise refrigerator, comprising either of the above rack appratus, at uppermost rack opening in a storage compartment or chamber of the refrigerator. By such arrangement, easiness for using the uppermost rack opening is improved.

DETAILED DESCRIPTION OF THE INVENTION

Figure 1:
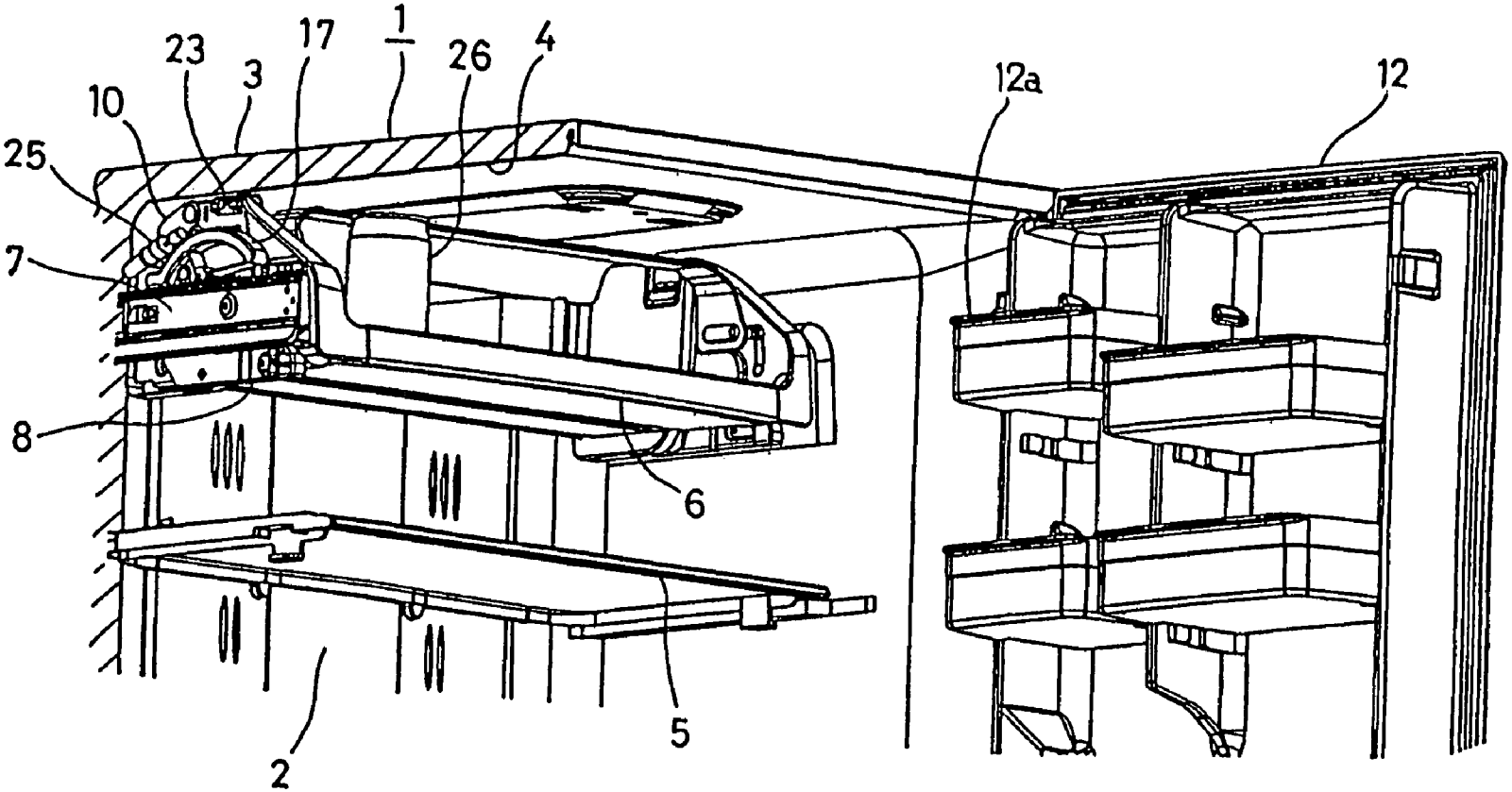
FIG. 1 is a cutout perspective view showing inside of the refrigerator in first embodiment of the invention.

An embodiment of the present invention will be described with reference to the drawings. FIG. 1 is a perspective view showing uppermost portion of a fresh food compartment (2) disposed at upper part of a refrigerator proper (1). Storage compartments including the fresh food compartment (2) and not-shown freezer compartment are formed by inner encasement (4), which is placed in an outer encasement (3) with heat-insulator interposed therebetween.

The fresh food compartment (2), which is located at uppermost part of the refrigerator proper (1), is partitioned by shelves (5) to form a plurality of receiving spaces, as in a prior-art refrigerator. Into the fresh food compartment (2), cooled air generated by a not-shown cooling device, which is located at backside of the refrigerator proper (1), is introduced by a fan.

Figure 4:
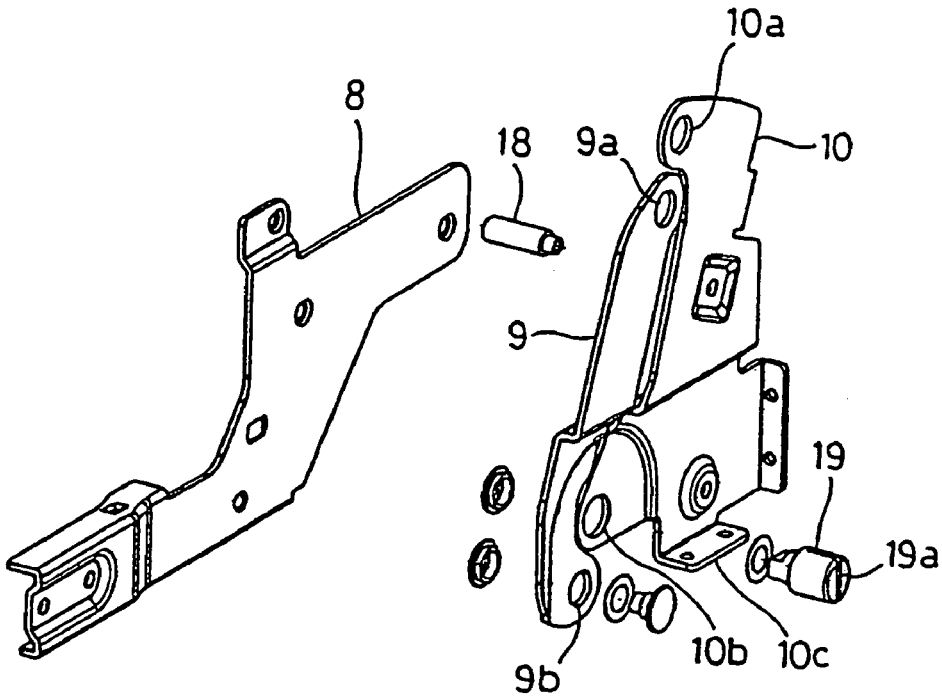
FIG. 4 is an exploded perspective view showing the traveling rail and an arm as well as their relationship.

Numeral 6 designates a rack container formed over entire width of the uppermost part of the fresh food compartment (2). The rack container (6) has peripheral walls as to form a receptacle and is widely opened at its front side by reducing height of front-side part of the peripheral wall. Backside part of the peripheral wall as a vertically raised wall has slightly reduced height as to facilitate introducing of the cooled air sent from the fan into the rack container (6). In otherwise, a duct for cooled air may be extended from the backside of the refrigerator proper (1) toward ceiling of the fresh food compartment (2), as to send out the cooled air from upward and thereby improving cooling efficiency. The rack container (6) is held as to be shiftable into-and-fro direction and turn-wise shiftable in up and down direction by following construction: stationary rails (7) are disposed depth-wise horizontally on right and left walls of uppermost part of the inner encasement (4); traveling rails (8) slide on inside of the stationary rails (7) respectively; front arms (9) and rear arms (10), detail of which are shown in FIG. 4, are hinged on base face of the traveling rails (8); and rack supports (11) are disposed as shown in FIG. 5.

Figure 2:
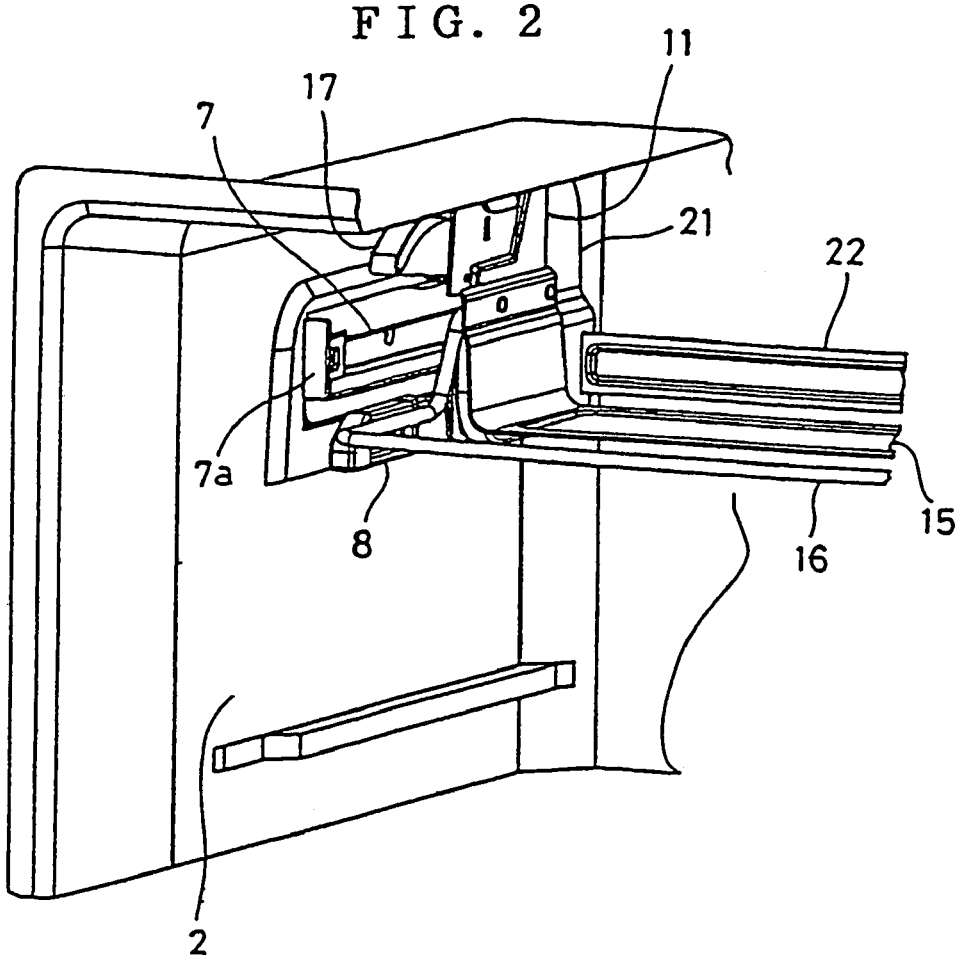
FIG. 2 is a perspective view showing a rack mechanism in FIG. 1, within a fresh food compartment.

In following, it will be described in detail a construction that enables shifting of the rack container (6) in to-and-fro and up-down directions. As shown in FIG. 2, which is a view of the rack mechanism (shown in FIG. 1) seen from inside of the refrigerator, the stationary rails (7) are located at certain height and extending in a depth-wise or to-and-fro direction at upper part of the fresh food compartment (2). Depth-wise dimension of the rack container (6) is about half of that of the fresh food compartment; in view of that inward pockets (12*a*) or pockets on inner face of the door (12) considerably protrude to inward of the compartment when the door (12) is closed to cover up front opening of the compartment, and that volume of the inward pockets (12*a*) has become larger and larger in these years.

Figure 3:
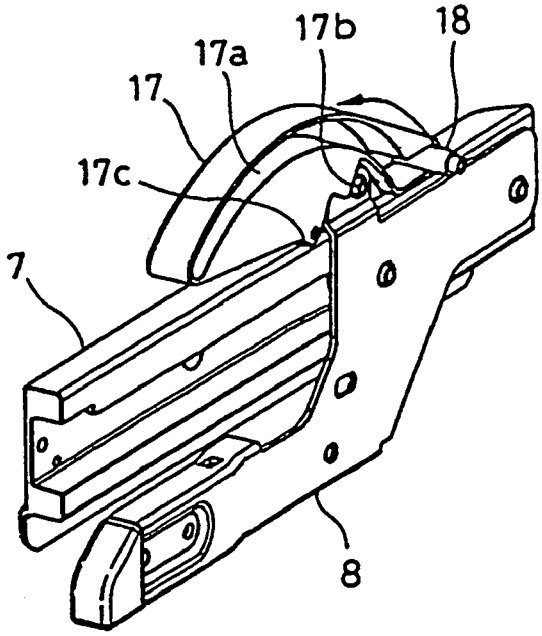
FIG. 3 is a detailed perspective view showing a traveling rail and a stopper that are appeared in FIG. 2.

As shown in FIG. 3, on inside of the each stationary rail (7) having angled-C-shaped cross section, the traveling rail (8) is disposed as to be horizontally slidable by two pulleys (13) (see FIG. 14), which are attached on upper fringe portions on outward face of the traveling rail (8). The traveling rail (8) holds a rack support (11) through fore arm (9) and rear arm (10) as to be parallelly shiftable in accordance of turning of the arms (9) (10), by following construction. Lower portions of fore arm (9) and rear arm (10) are hinged on inward face of lower portion at base plate of the each traveling rail (8), at spaced-apart hinge positions or hinged portions (9*b*) (10*b*) such that the arms (9) (10) are freely turnable in one way or other. Moreover, the arms (9) (10) are hinged on the rack support (11) respectively at two adjacent working points (9*a*) (10*a*), each of which is on a distal end at respective one of the fore and rear arms (9) (10).

Figure 5:
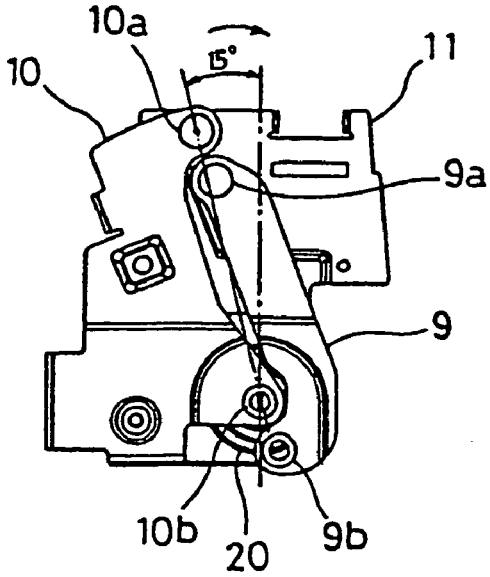
FIG. 5 is a side view showing fore and rear arms and a rack support in their assembled state.

As shown in FIG. 5, the working points (9*a*) (10*a*) are disposed, with respect to spaced-apart hinged portions (9*b*) (10*b*), at a direction backwardly slanted by 15° from vertical upward of the spaced-apart hinged portions (9*b*) (10*b*). Thus, when the arms are turned forward, the distal ends of the arms as well as the rack support moves transiently upward and then downward.

Figure 6:
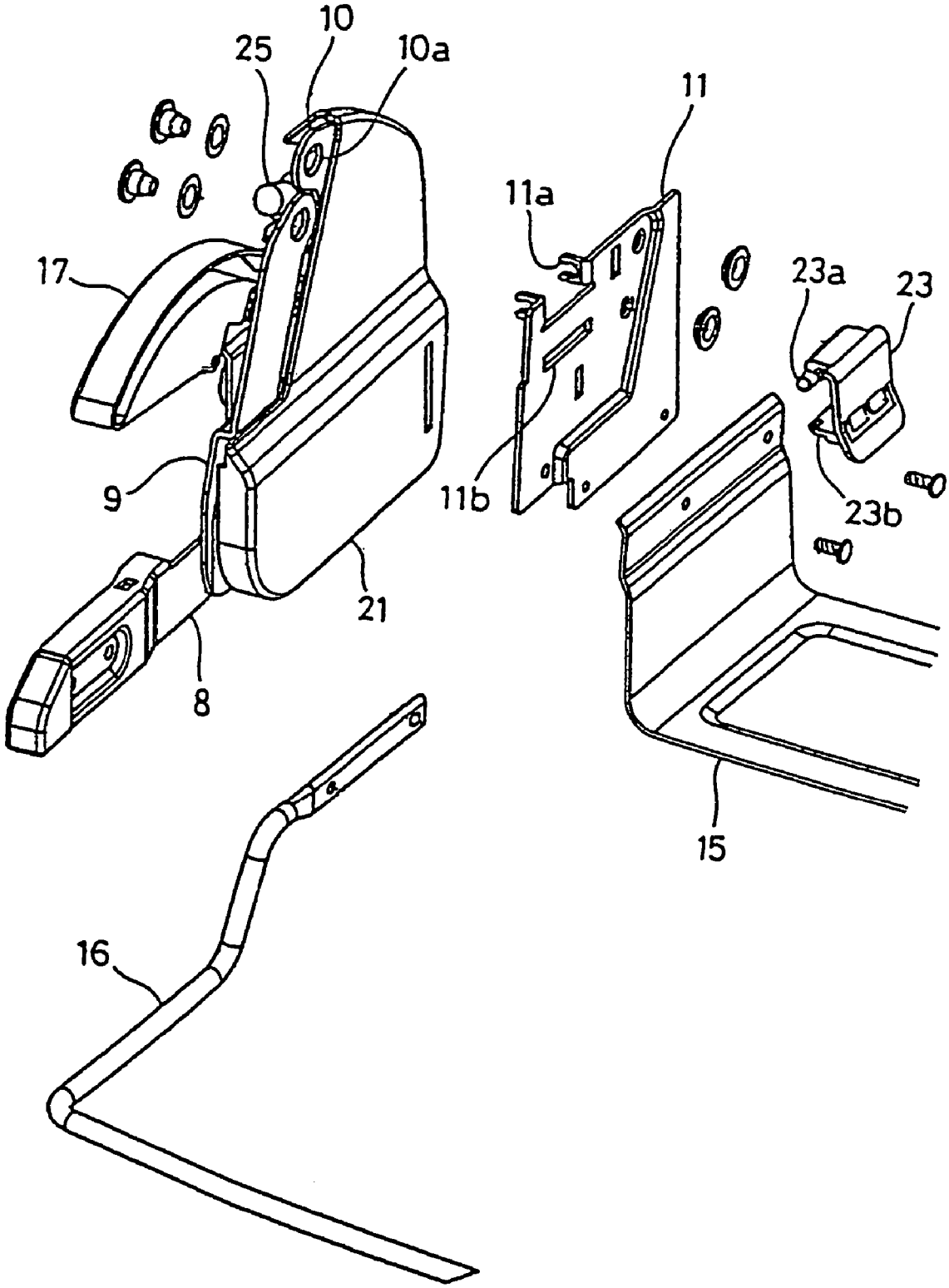
FIG. 6 is an exploded perspective view showing elements of the rack mechanism and their relationship.

As understandable from FIG. 6 showing an exploded view of the functional elements, the rack supports (11) are respectively disposed at right and left walls of the fresh food compartment; and on the rack supports (11), a rack receiving element (15) along with reinforcing frame (16) are screw-fixed, the reinforcing frame (16) being formed of metal wires and thrusting forward as casing-rim-wise bowed between the screw-fixed position. By such constructing of a part for receiving a rack container (6), reinforcement for the rack container (6) is made without forming a reinforcing structure in the rack container (6) itself. In this way, the rack container (6) laid thereonto is shiftable back and forth along the stationary rails (7) and shiftable up and down direction by turning of the arms (9) (10).

In hereto-explained example, the rack support (11) and the rack-receiving element (15) are separately prepared and assembled afterward, in view of preparing and transporting of elements for the rack mechanism. In otherwise, they are constructed as one member before attaching onto fore and rear arms (9) (10).

On upper part of the traveling rail (8), a stopper (17) is hinged as to be freely turnable in one way or other about a hinged portion (17*b*). The stopper (17) restrains the turning of the fore and rear arms (9) (10). When the traveling rails (8) arrive foremost position on the stationary rails (7), the stopper (17) allows turning of the fore and rear arms (9) (10) and thereby allows the arms and rack support (11) shift forward. Then, the rack container (6) on the rack-receiving element (15) as well as rack support becomes shifted downward.

The stopper (17), as clearly shown in FIG. 3, is sector-shaped and has a linkage groove (17*a*), which extends back to forth along a horizontal line and then continuously along arc fringe of the sector shape. A guide pin (18) is disposed to protrude outwardly from the rear arm (10) and engages with the linkage groove (17*a*) as freely slidable. Thus, when the rear arm (10) is turned forward, the stopper (17) turns about the hinged portion (17*b*). The stopper (17) has a protrusion (17*c*) in vicinity of the hinged portion (17*b*). The protrusion (17*c*), which is engaged on top face of the stationary rail (7), is shifted with forward shifting of the traveling rail (8), and thereafter engages with front end face of the stationary rail (7) as to restrain rearward shifting of the traveling rail (8).

Figure 7:
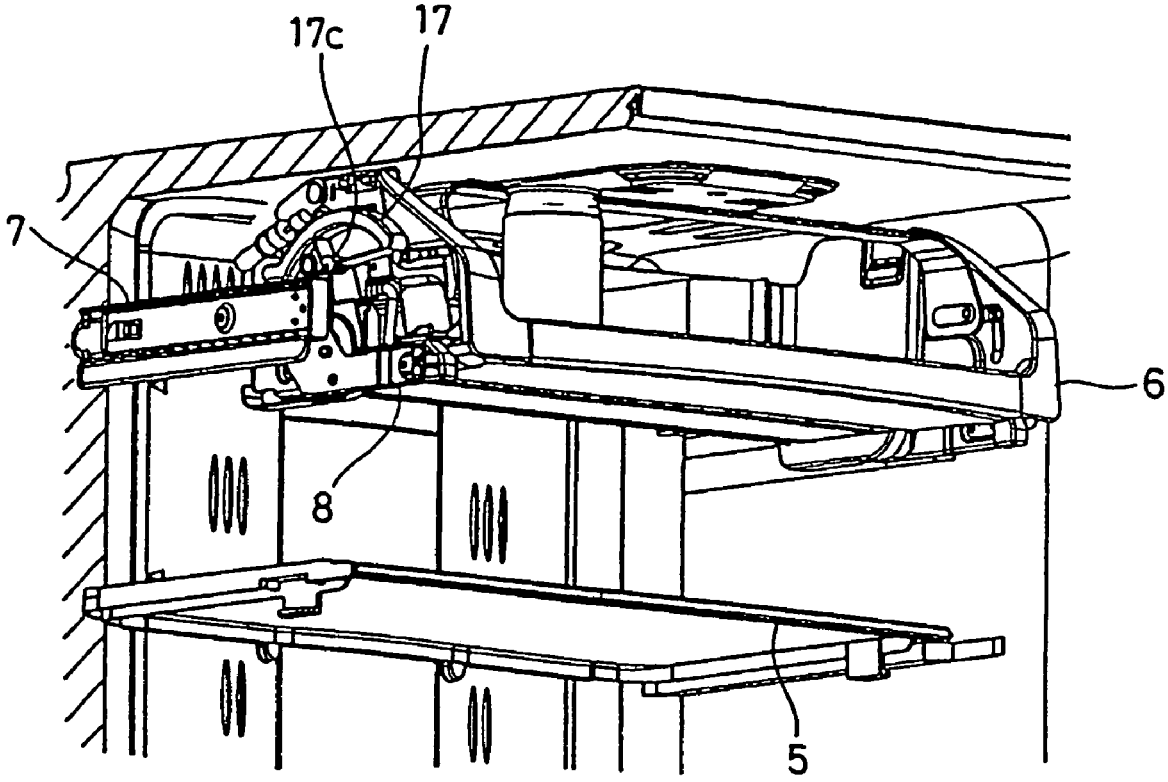
FIG. 7 is a cutout perspective view, for a part as in FIG. 1, showing a state in which the traveling rails are pulled forward.

During horizontal shifting of the traveling rail (8), as shown in FIG. 7, turning of the stopper (17) is blocked because the protrusion (17*c*) abuts on the top face of the stationary rail (7), as to prevent turning of the fore and rear arms (9) (10). Thus, downward turn-wise shifting of the rack container (6) is averted during the horizontal shifting of the traveling rail (8). If the rack container (6) were shifted downward during the forward shifting from rearmost position, the rack container (6) would collide and inflict damage onto food items on downward adjacent shelf.

When the traveling rail (8) arrives foremost position on the stationary rail (7) and is stopped, the protrusion (17*c*) of the stopper (17) leaves out from upper face on the front end of the stationary rail (7). Then, the stopper (17) becomes allowed to turn downwardly, thus enabling downward turn-wise shifting of the fore and rear arms (9) (10) as well as the rack container (6).

Figure 8:
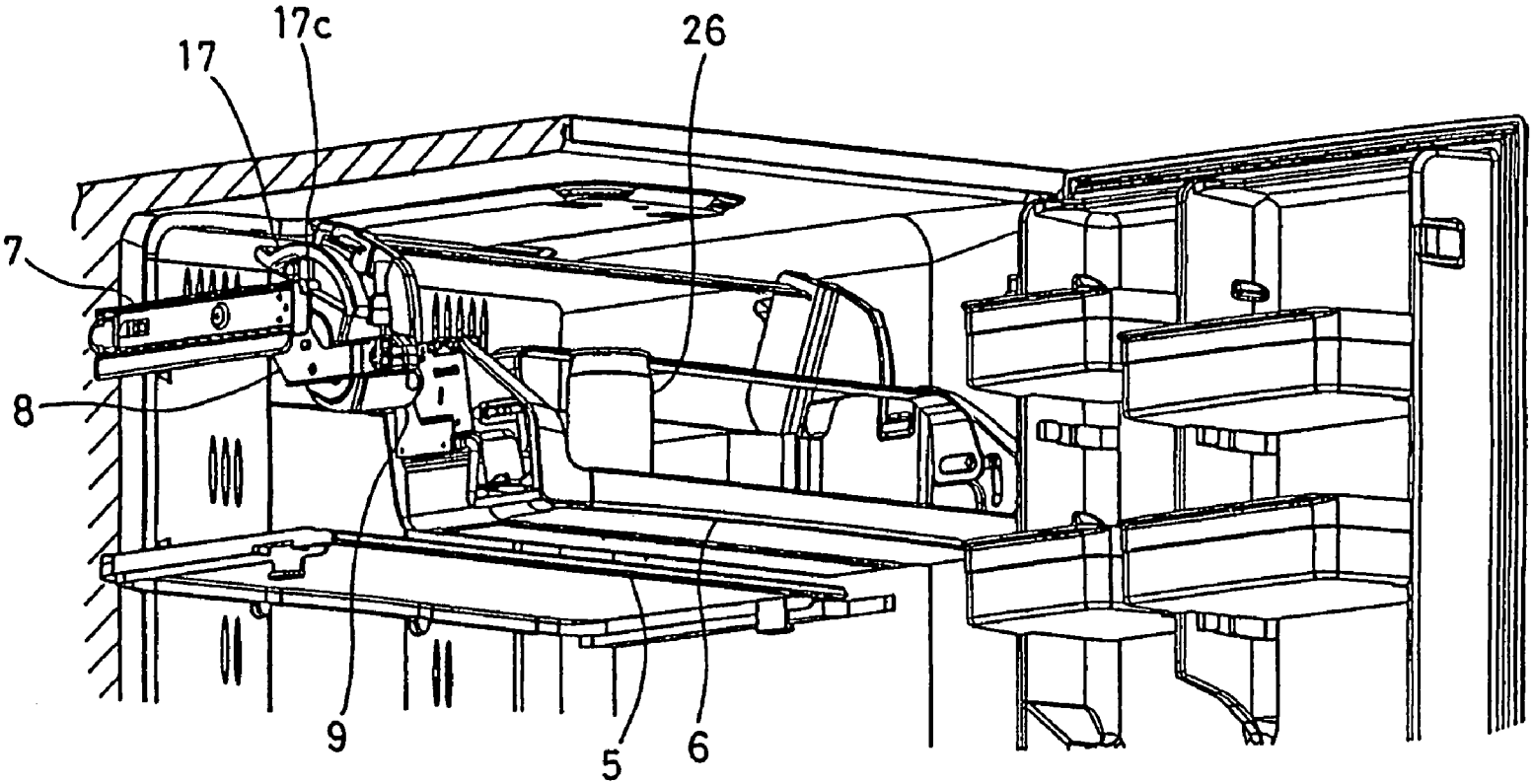
FIG. 8 is a cutout perspective view, for a part as in FIG. 1, showing a state in which the rack container has been shifted downward at foreside.
Figure 9:
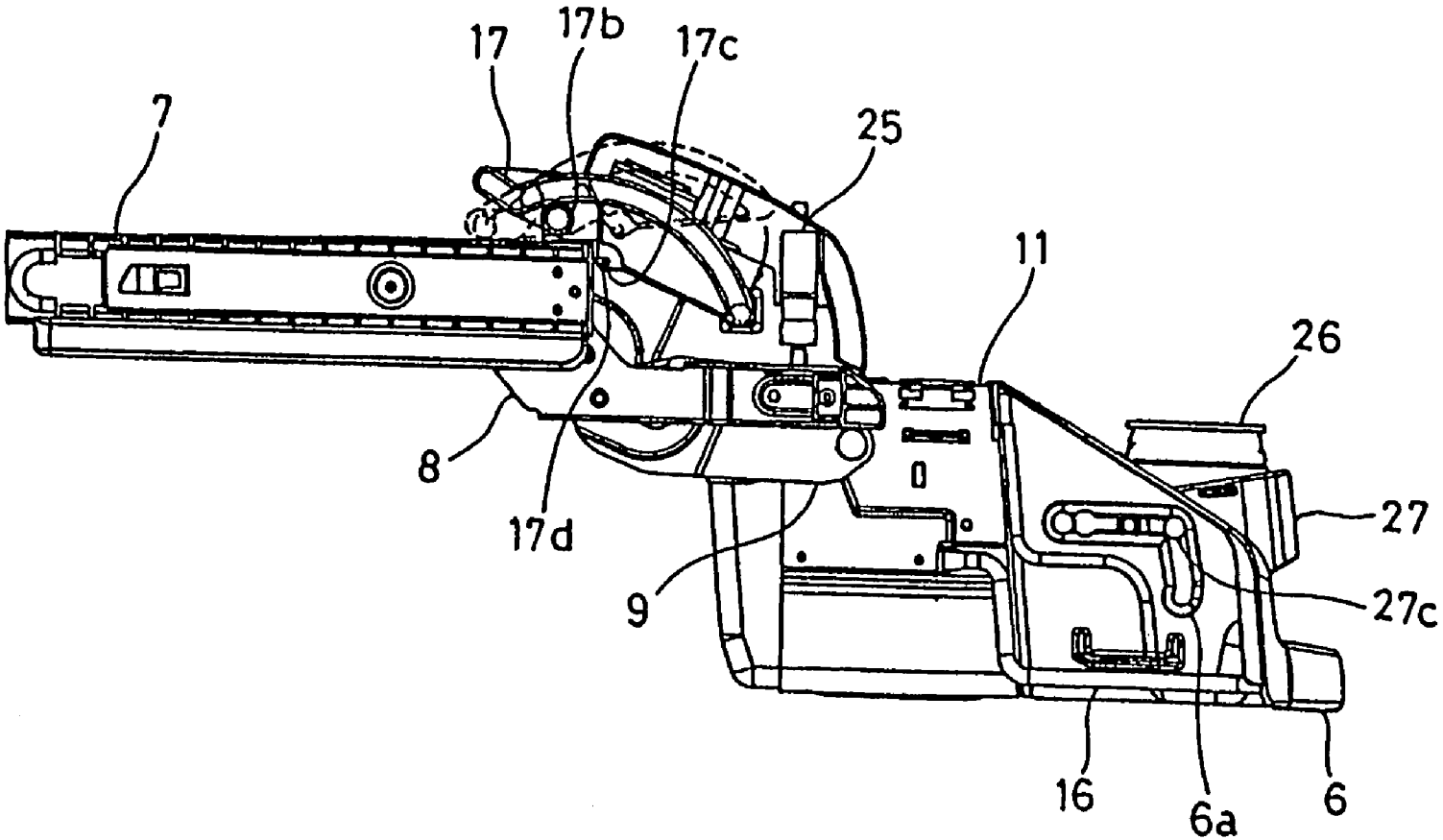
FIG. 9 is a side view showing the rack mechanism and the rack container that are appeared in FIG. 8.

Resulted from turning of the stopper (17) around hinged portion (17*b*), as shown in FIGS. 8 and 9 respectively showing perspective and side views of the rack container (6), the protrusion (17*c*) engages with front end face of the stationary rail (7). In this way, backward horizontal shifting of the traveling rail (8) is prevented and thus direct backward sliding of the rack container, which may otherwise cause colliding with the food items on the downward adjacent shelf in a similar manner as explained earlier.

Onto such protrusion (17*c*), which works as explained above, a pulley (17*d*) may be disposed as to facilitate sliding while abutting with top face of the stationary rail (7).

Figure 10:
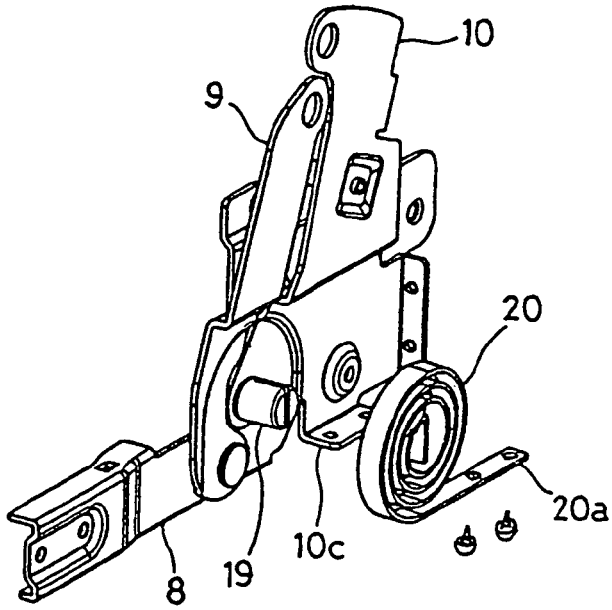
FIG. 10 is a perspective view showing a state to attach a spiral spring on the rear arm.

As shown in FIG. 4 as well as FIG. 10 showing same with assembled state, spiral spring (20) is attached on the hinged portion (10*b*) of the rear arm (10). The spiral spring (20) is formed of narrowly elongated leaf spring that is wound up concentrically. Center-portion end of the spiral spring (20) is fixed in a slit (19*a*) on a support shaft (19); and the outer end (20*a*) of the spiral spring (20) is screw-fixed to a flange (10*c*) on bottom fringe of the rear arm (10). Thus, when the rear arm (10) forwardly turned, the spiral spring (20) exerts force on the rear arm (10) in direction of returning, that is force for upward and rearward turning of the rear arm (10).

The fore and rear arms (9) (10) hold upper portions of the rack support (11) and the rack container (6), and downwardly turn about hinged portions (9*b*) (10*b*) at lower portions of the arms (9) (10). Then, the working points (9*a*) (10*a*) on upper portions of the arms (9) (10) come downward of the hinged portions (9*b*) (10*b*). In this way, dimension between uppermost and lowermost positions of the rack container (6) is made large. In above construction, the arms (9) (10) do not protrude into upside of the rack container (6) or the like, and hence eliminating such a space that is not usable other than turn-wise motion of the arms.

The spiral spring (20) is not so small in width-wise dimension, however, may be disposed within a dead space, which is formed on lower part of the rack-supporting mechanism and on a slanting wall of the rack container (6) designed for extracting from a mold tool. In such construction, volume ratio of usable space in the rack container is enhanced, while restraining a gravity-driven downward moving speed of the rack container (6). Conversely, when to heave up the rack container (6), the spiral spring (20) imparts upward force and relieves load for the heaving up. In this sense, load or force of the spiral spring (20) is designed to be 1 to 5 kg.

A questionnaire survey is made to ordinary women as for this specific embodiment, and reveals that permissible load for heaving up and hauling down is about 30N. In view of this, the maximum hauling down load when no food items are thereon is set at about 30N; and heaving up load from lowermost position when 3 kg of items are loaded on is also set at about 30N, where 3 kg is maximum loading amount in usual usage. Thus, as far as loading amount on the rack container is ordinary, up and down moving of the rack container may be made within or below of the about 30N of permissible load for ordinary women.

Typical coil spring may be used instead of the spiral spring; however, by adopting the spiral spring, abrasion or squeaking sound is averted even if turning angle of the rear arm (10) on moving from rear-uppermost position to fore-lowermost position is about 110-115°.

A spring cover (21) shown in FIG. 6 is disposed at inward side facing the rack container (6), of the fore and rear arms (9) (10) as to cover the spiral spring (20) attached on such side. The spring cover (21) improves ornamental appearance by covering the spiral spring (20), which would be otherwise exposed while the rack container (6) is downwardly shifted. Moreover, the spring cover (21) prevents that fingers of user is pinched at spiral spring (20) or the like.

The rack support (11), on which the fore and rear arms (9) (10) are fixed as to be linked, is disposed inward side of the arms (9) (10) and the spring cover (21). The rack-receiving element (15) is, as previously explained, screw-fixed onto lowermost portions of the rack supports (11) on right and left sides as hanged between them; and the reinforcing frame (16) being screw-fixed altogether. As further seen from FIG. 11 showing an assembled mechanism for holding the rack container, a rear frame (22) connects the rear arms (10) on right and left sides, at their rear fringe portions of the lower part.

The rear frame (22) is disposed at backside of the rack container (6) when the rack container (6) is shifted back to upside-rear retracted position. This is to avoid hampering of turning motion of the mechanism for holding the rack container, and to avoid interfering with motion for taking out food items on the rack container when the rack container is turned underside-fore position.

The rack container (6) is disposed between the right and left mechanism for holding the rack container (6). At this occasion, lower fringe on foreside of the rack container (6) is embraced by the reinforcing frame (16); and the rack container (6) is supported at its bottom by the rack receiving element (15) and is unlatchably latched, with a rack fastener (23), on top face of the each rack support (11) by top fringe of rack container (6).

Figure 11:
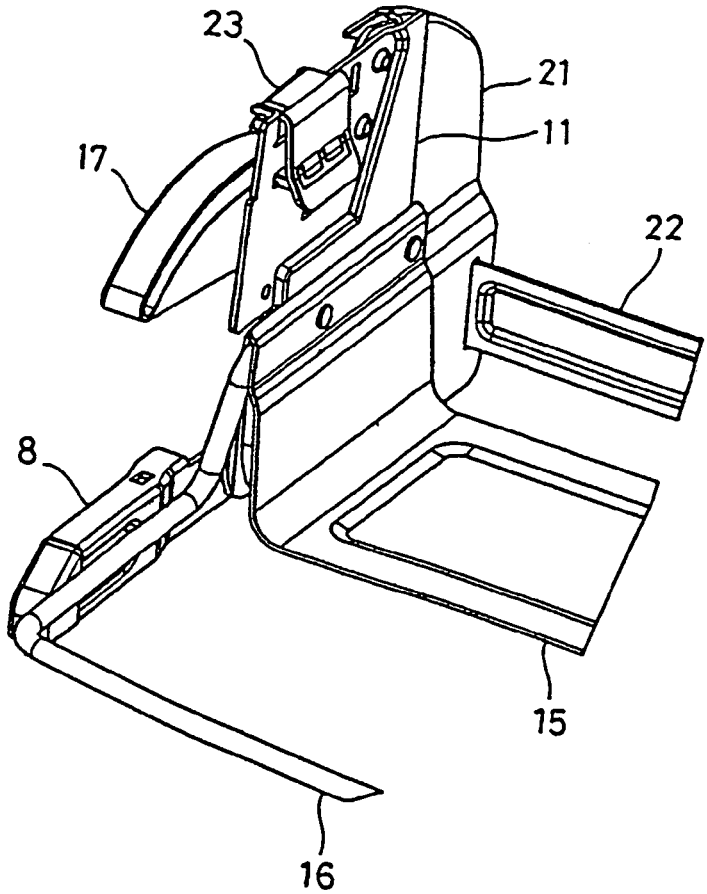
FIG. 11 is a perspective view showing an assembled sate of the rack mechanism shown in FIG. 6.

The rack fastener (23) is attached in a following manner as shown in FIGS. 6 and 11. Its pivot portions (23*a*) are fitted into bearing portions (11*a*) on upper-fringe cutout of the rack support (11). The rack fastener (23) has a fastening projection (23*b*) that is to engage with a through hole (11*b*) provided at below of the bearing portion (11*a*) as to hold upper fringe of the rack container (6). Even when the rack container (6) is taken away, the rack fastener (23) is held on supporting portion (11*a*) of the rack support (11). In above manner, chance of missing the fastener is eliminated, whereas the attaching and detaching of the rack container (6) may be made in otherwise by screw fastening or other fastener.

Figure 12:
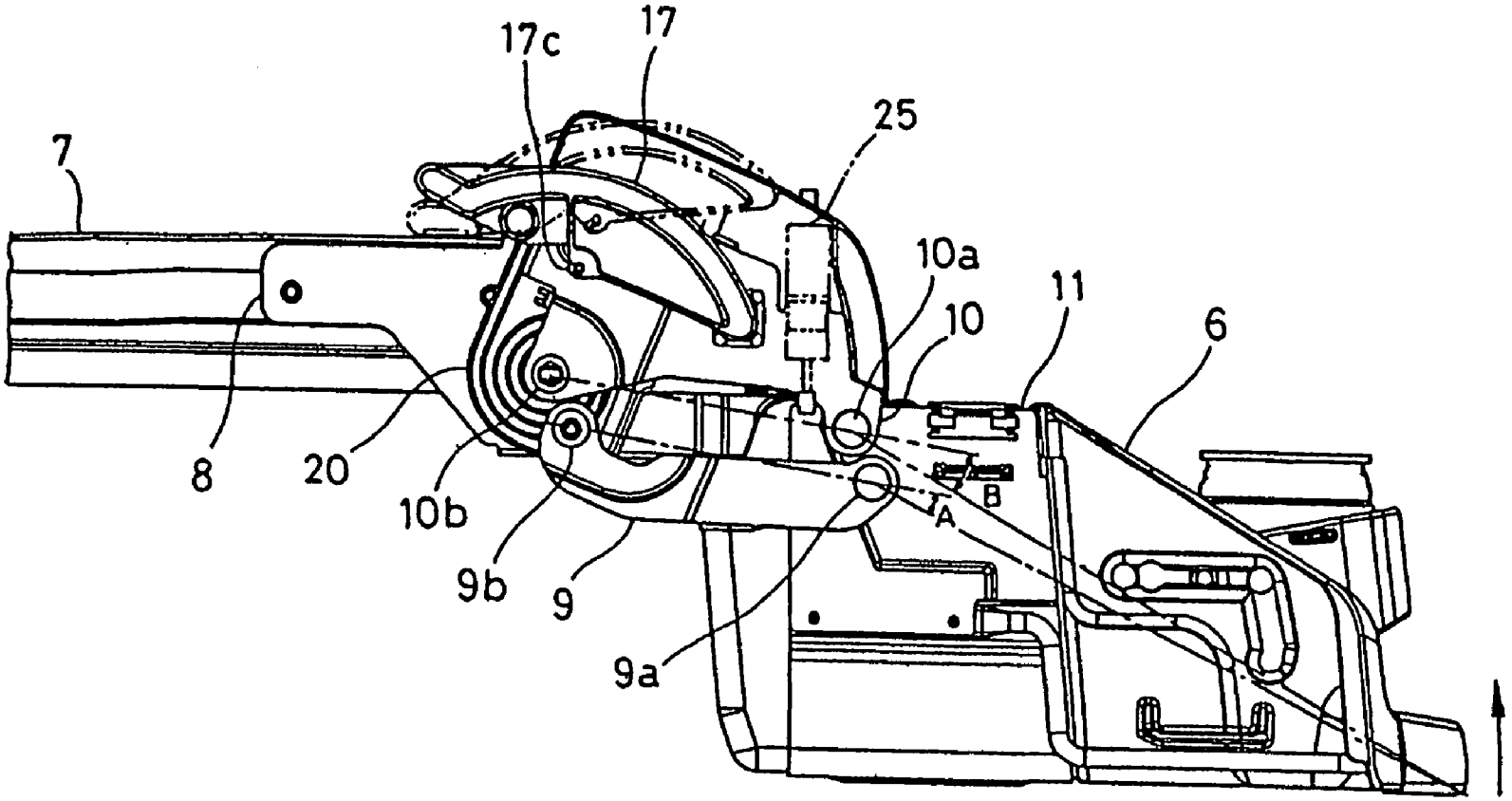
FIG. 12 is a side view showing relationship between the arms and a rack container at downwardly shifted state.

As shown in FIG. 12, when the rack container (6) is pulled forward and then downward, the arrangement in respect of the side view is made as follows. First straight lines are assumed which connects front-bottom ridge of rack container (6) and the working points (9*a*) (10*a*). Second straight lines are assumed which connects the hinged portions (9*b*) (10*b*) and the working points (9*a*) (10*a*). The second straight lines bend downward from the fist straight lines by angles A and B, which are larger than 10 degrees.

Such arrangement prevents lopsided heaving as below. When the rack container (6) at bottom position has about 10 kg load thereon for example, grabbing up of handle portions at front edge of the rack container (6) for heaving it up might cause that heaving lopsided to front part. In such occasion, rearward shifting is also prevented by the abutting or the projection (17*c*) of the stopper (17) with the stationary rail (7). The above arrangement averts such occasion and facilitates smooth lifting of the rack container (6) with relatively small force, accompanied with upward force generated by the spiral spring (20).

The larger the angles A and B between the assumed straight lines, the larger become effect of facilitate lifting up. On other hand, storage volume should be large enough by sufficient dimensions in width and depth. As a result of trials, it is revealed that the above value of the angles or more is enough.

Figure 13:
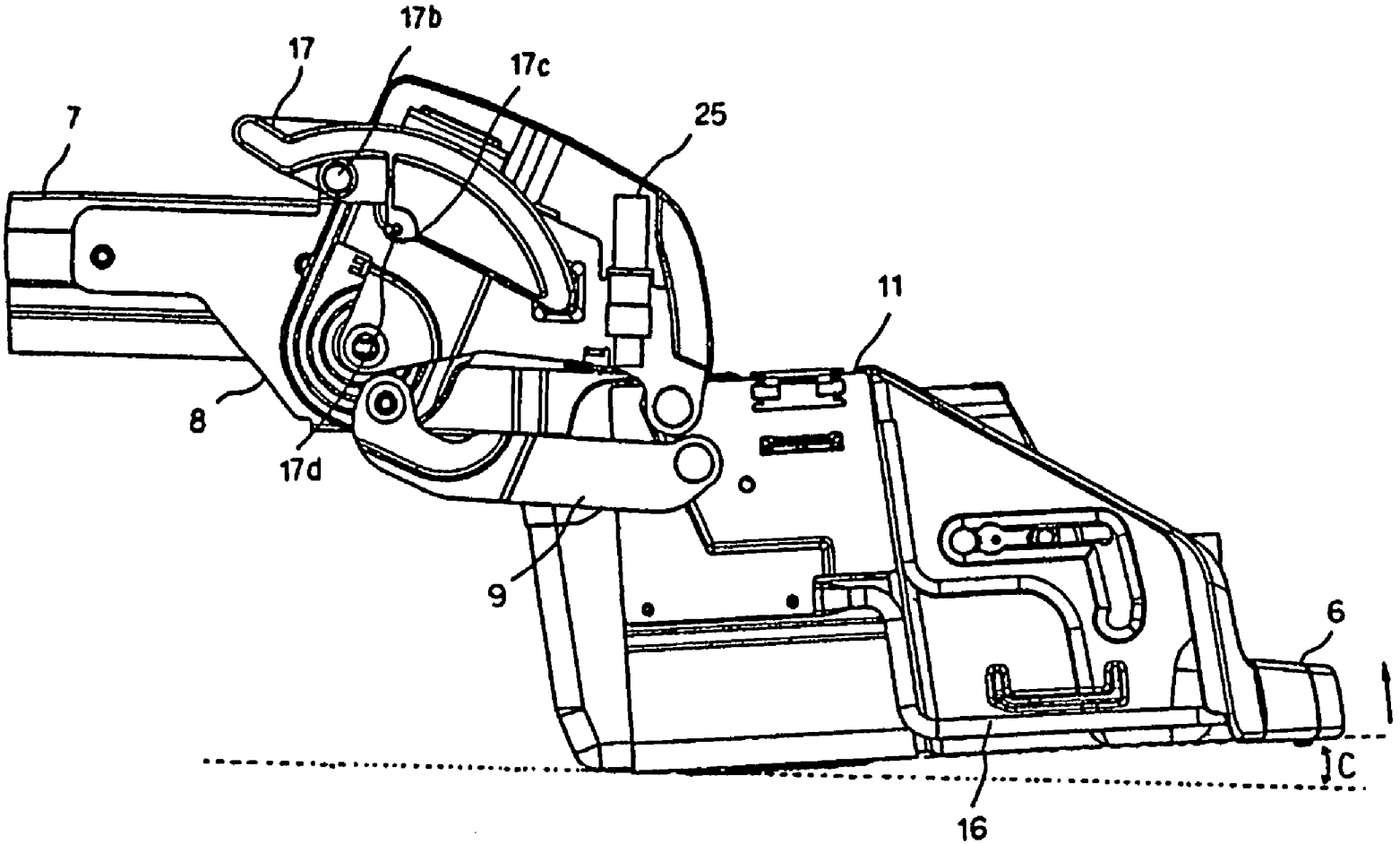
FIG. 13 is a side view showing an embodiment where bottom face of the rack container is inclined to be raised forwardly.

As in another embodiment shown in FIG. 13, bottom face of the rack container may be inclined to have upward slope angle C in 3-6 degrees for example, viewed from rear end to forward. If the door (12) is closed when the rack container (6) is in lowermost position or suspended on way to the lower most position, inward pockets (12*a*) or bead portion (12*b*) of the door (12) collide with the rack container (6). In such occasion, the upward slope angle C of the bottom alleviates load applied on hinged portions (9*a*) (10*a*) of the fore and rear arms (9) (10) that hold the rack container (6), by turning upward front-side portion of the rack container as indicated by an arrow. Moreover, such upward slope angle as in 3-6 degrees, accompanied with friction on item-receiving face of the rack container, prevents the food items in the rack container (6) from forward jumping out. Further, resulted appearance does not cause unpleasant sense.

Figure 14:
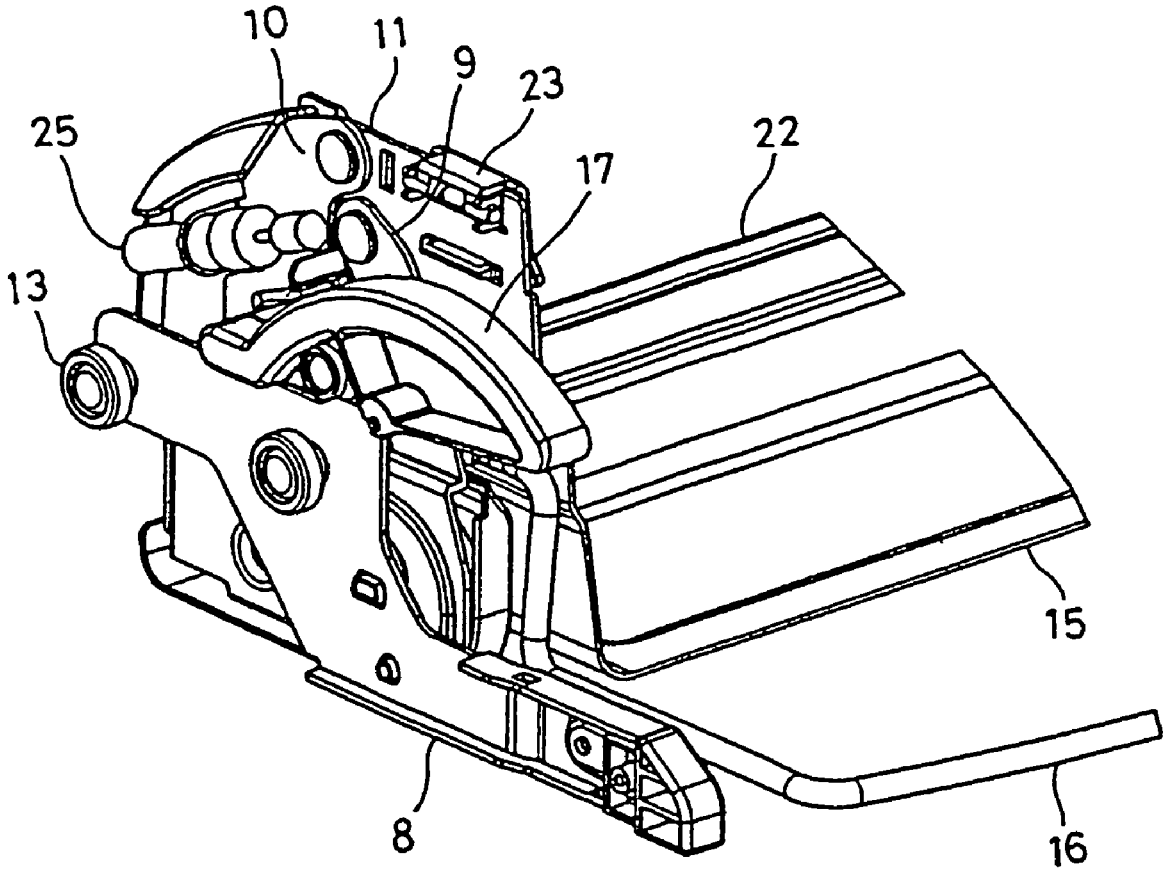
FIG. 14 is a perspective view showing a part shown in FIG. 11, as viewed from other side.

On outward face of the rear arm (10), there is fixed an oil damper (25) for damping at stopping of downward moving. At a time the rack container (6) reaches lowermost position, as seen in FIG. 9 as well as FIG. 14 showing same with FIG. 11 from outward, a rubber bushing on distal end of the oil damper (25) softly abuts on top face of the traveling rail (8) in accordance with turning motion of the arm (10) as to stop the turning motion.

The oil damper (25) is formed of a hollow cylinder and oil enclosed therein, and performs shock-absorbing action at a distant range of 10-70 mm from the lowermost position of the rack container (6). Such shock-absorbing force is set larger than the force by the spiral spring (20), for following reason. If the force by the spiral spring (20) is too strong, hauling down of the rack container having no load requires quite a force. Meanwhile, if the force by the spiral spring (20) is too weak, pulling down of the rack container having heavy load causes abrupt downward movement. In a detailed embodiment, the force by the spiral spring (20) is set at 2 kg, and the shock-absorbing force of the oil damper (25) is set at 3 kg.

In the embodiment, a piston-form oil damper is adopted as above. However, a piston-form air damper or a rotary air damper as well as any other damper that alleviates shock and collision sound may be adopted.

If an unshown magnet is attached on the distal end of the oil damper (25), the rear arm (10) temporarily adheres on top face of the traveling rail (8) when the rack container (6) reaches its lowermost position. This prevents rearward turning of the rear arm (10) and resulted unwilling lifting of the rack container (6).

Figure 15:
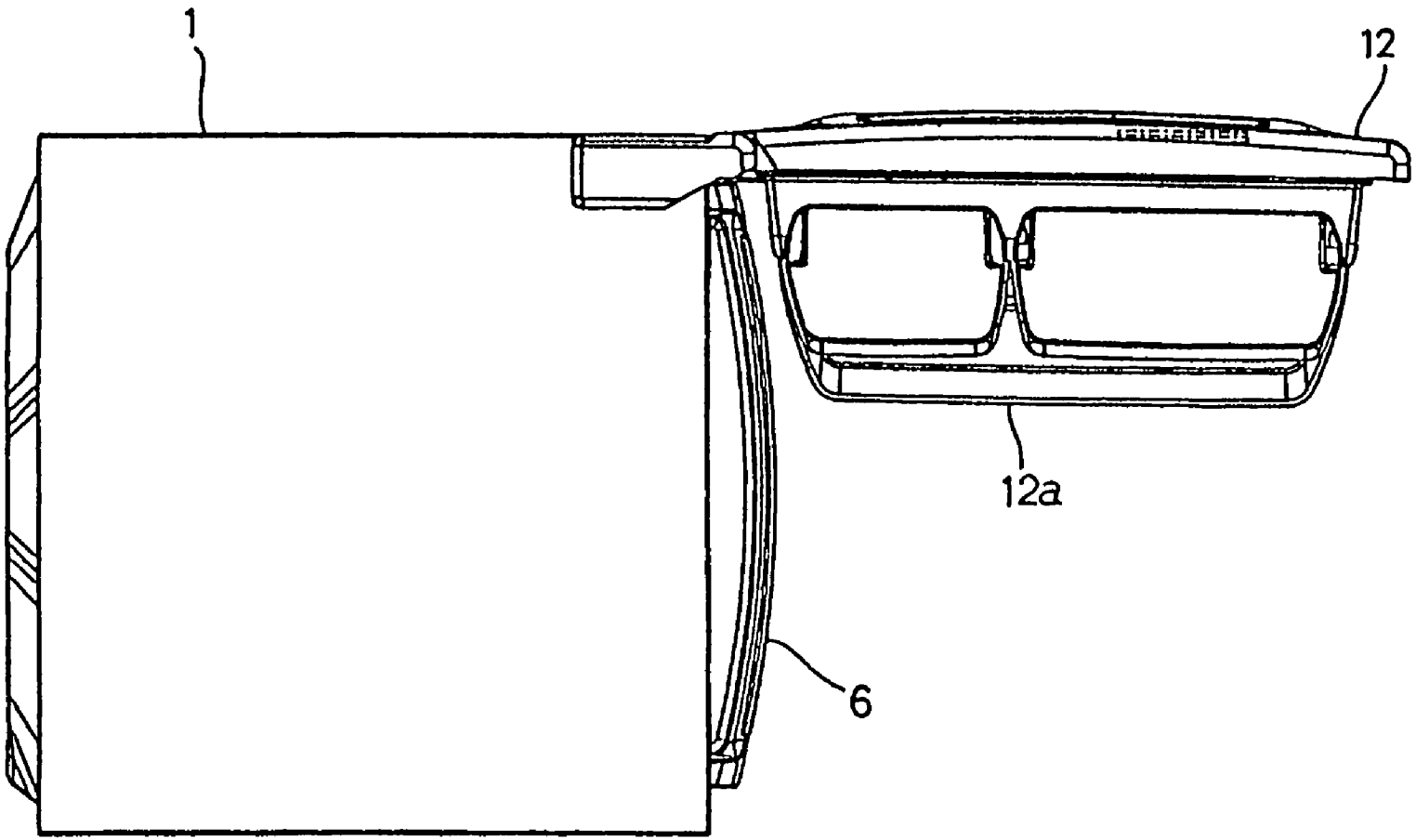
FIG. 15 is a plan view showing relationship between door pockets and the rack container at downwardly shifted state.
Figure 16:
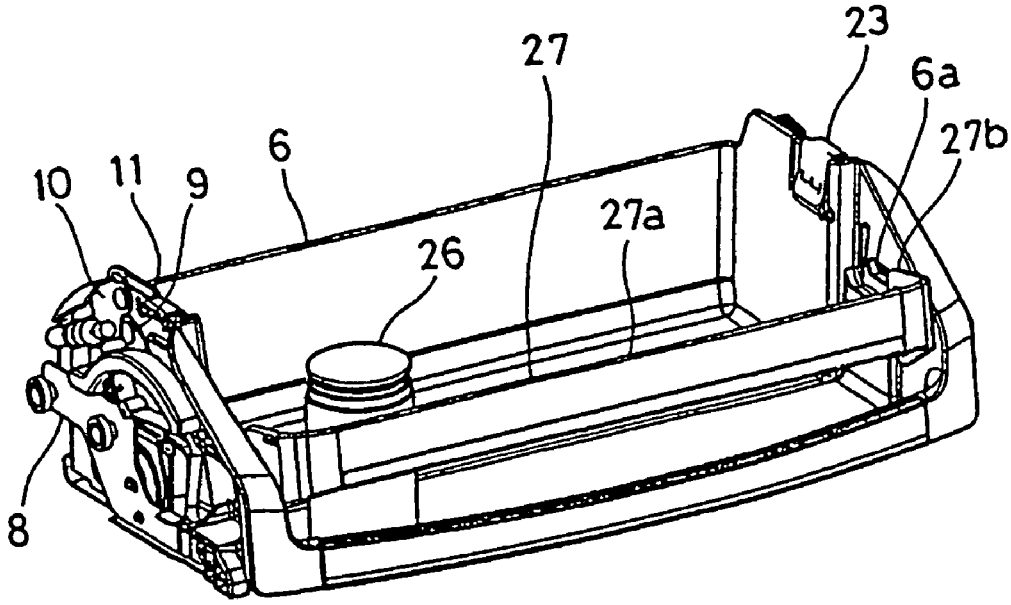
FIG. 16 is a perspective view showing a rack opening's guard.

Front face of the rack container (6) is formed as rounded to bulge out from its center portion. This is to avoid interfering between the front face portion of the rack container (6) and the inward pockets (12*a*) on the door (12). As shown in FIG. 15, when the rack container (6) is pulled down, the front face portion of the rack container (6) protrudes from openings of the refrigerator (1). Thus, the front face portion may interfere with the inward pockets (12*a*) when the door (12) is opened by around 90°. Therefore, the front face portion of the rack container is rounded as above, and a face opposite thereto on the inward pockets is arc-shaped in the plan view.

When the door (12) is closed while the rack container (6) is at pulled-down positions as mentioned above, shock of collision between them is alleviated by such rounded construction; and thus, damage or rupture of the inward pockets (12*a*) or the bead portions (12*b*) is to be avoided. By the rounded construction, a handhold is formed for a palm-downward hand position, as to facilitate putting muscles into pulling the rack container (6) forward and downward and to thereby improve easiness for use; and, ornamental appearance is improved.

Backside wall of the rack container (6) is relatively small in height-wise dimension as mentioned before; thus, not only the introduction of cooled air is facilitated but also detaching of the rack container (6) is easily made by slightly raising the rack container (6) and then pulling forward.

Figure 17:
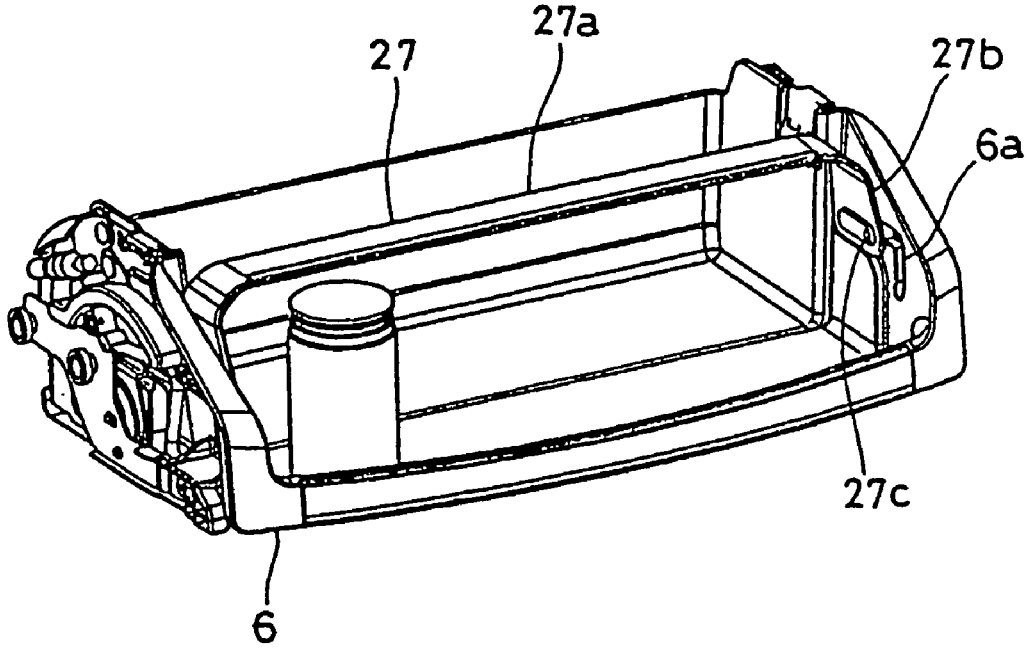
FIG. 17 is a perspective view showing the rack opening's guard positioned at upside of the rack container.

As for upward opening of the rack container (6), a rack opening's guard (27) is disposed. The rack opening's guard (27) has angled-C shape that is comprised of; a guard part (27*a*) extending over entire width of the rack container (6); and supporting parts (27*b*) bent from right and left ends of the guard part (27*a*) as extend along inner faces of the rack container (6). The each supporting part (27*b*) has an engaging protrusion (27*c*) that outwardly protrudes and engages with L-shaped groove (6*a*) on fore part of the inner face of the rack container (6). By sliding of the engaging protrusion (27*c*) in the L-shaped groove (6*a*), the guard part (27*a*) may be positioned either along front face of the rack container (6*a*) or at upside shown in FIG. 17.

The rack container (6) is widely opened to forward and has a front wall small in height dimension. Thus, at pulling down or heaving up of the rack container (6), it arises possibility that beverage cans turn flat or drop out. Nevertheless, such possibility is eliminated or averted when the rack opening's guard (27) is turned forward to be positioned at foreside. If the height of the top face of the rack opening's guard (27) from bottom face of the rack container (6) is set at about 80-90 mm, items stacked on a PET bottle in flat position are held as retained.

Meanwhile, when the rack opening's guard (27) is positioned at upright position, front side of the rack container (6) is widely left open; thus, procedure of taking the items away and into the container is facilitated. Further, in view of the fact the rack container (6) is turned back to be placed in upside-rear retracted position, the guard part (27*a*) may be used as gauge for acceptable height of the items to be accommodated in order for avoiding contact between the items and ceiling of the storage compartment.

As evident from the above construction, rack mechanism including the fore and rear arms (9) (10), the rack support (11), the rack receiving element (15) and the stopper (17) does not protrude into a space straightly downward of the rack container (6) in the upside and rearmost retracted position even when the rack container (6) is pulled forward and then downward. To this end, the rack mechanism is designed with respect to hinge and working positions and turning relationship to the stationary and traveling rails (7) (8). By such construction, the rack mechanism does not protrude into the space downward of retracted container; so as not to contact with the items on downward adjacent shelf or so as not to cause resulted dropping out of the items or other damages.

In the above rack mechanism, part of the traveling rail (8) is inserted into a groove of the stationary rail (7), which has a section of angled C shape. Subsequently, forward opening of the groove of the stationary rail (7) is blocked by a front stopper (7*a*), then being placed in the fresh food compartment (2). As above, attaching of the front stopper (7*a*) on the forward opening of the groove is made after that, on inside of the stationary rail (7), the traveling rail (8) is disposed, with which the fore and rear arms (9) (10), rack support (11) and the rack receiving element (15) are integrally assembled. When the rack container (6) is pulled forward, a pulley (13) of the traveling rail (8) collides onto the front stopper (7*a*) and causes percussive sound. In the embodiment, as to relieve such percussive sound, part for attaching on the stationary rail (7), of the front stopper (7*a*), is formed of rubber or other elastic material that relieves collision impact between the pulley (13) and the front stopper (7*a*).

In following, operation of the inventive mechanism will be explained. When the door of the fresh food compartment (2) is closed, at normal position of the rack container as shown in FIG. 1, the traveling rail (8) is at rearmost position on the stationary rail (7), and the fore and rear arms (9) (10) are erected or oriented in up-down direction and on rear side of the traveling rail (8); and the rack container (6) is held at rear part of the uppermost space in the compartment.

When to pull down the rack container (6) for taking food items (26) into and from the rack container (6), a user grabs and pulls forward the rack container (6) at its front face portion. Then, the traveling rails (8) slide with pulleys (13) along the stationary rails (7) until traveling a distance about two third of the depth-wise dimension of the stationary rail (7), to a state shown in FIG. 7, while being continuously supported from the pulleys (13).

In such state, the stopper (17) of sector shape attached on the traveling rail (8) is prevented from turning because protrusion (17*c*) is on top face of the stationary rail (7). Thus, the guide pin (18) cannot travel within the link groove (17*a*), and thereby, the rear arms (10) do not turn and the rack container does not shift downward.

Then, the traveling rail (8) reaches at foremost position and the protrusion (17*c*) of the stopper (17) slips away from fore end of the stationary rail (7). At this time point, along with the stopper (17), the fore and rear arms (9) (10) are become turnable. At this time, the guide pin (18) fixed on the rear arm (10) is positioned within a horizontal part of the link groove (17*a*); and, at first, the working points of the arms generates upward force in response to force for pulling forward, thus making resistance to motion of the pulling forward. In view of this and that the rack container (6) is pulled forward, the user may take the food items (26) into and from the container in this state.

To father facilitate taking-in and out of the items, the rack container (6) is pulled slantly downward by grabbing the front face portion of the rack container (6). By this procedure, stoppers (17) become turnable and, in same time, the fore and rear arms (9) (10) become turnable so that the arms (9) (10) turn downward around the hinged portions (9*b*) (10*b*). By the rack supports (11), each of which is coupled and engaged with the arms (9) (10) at their respective working points (9*a*) (10*a*); the rack container (6) on the rack supports (11) and the rack receiving element (15) descends with keeping its horizontal posture by a height-wise dimension tantamount to a space between the shelves; until reaching fore side of the openings of the refrigerator proper (1) as shown in FIG. 8.

At lowermost position of the rack container (6), height of bottom face of the rack container (6) is set as 140 to 155 cm from the floor. Average stature of women, who are main user of the refrigerator, is about 158 cm, in Japan; and the height of the bottom face is set to agree with that of the eye line of the average-stature women. In this way, the food items on the rack container are fully visible and easy to be taken in and out. Weight of the rack container (6) and rack holding mechanism added with weight of the food items may become considerably large; however, assisted by upward force of the spiral spring (20), downward shifting is made with relatively small load.

On way of such downward shifting, the protrusion (17*c*) of the stopper (17) engages on front-end face of the stationary rail (7), after turning of the guide pin (18) by the rear arm (10). Even if the user tries to push backward the rack container (6), backward shifting is prevented by a stopper action. After further downward shifting of the rack container (6), the rubber bushing at distal end of the oil damper (25), which is fixed on the rear arm (10), abuts on top face of the traveling rail (8) that has been traveled forward. In this manner, while mechanical shock being absorbed as noise being restrained, the rack container (6) is prevented from further downward shifting and kept at fixed position.

Figure 18:
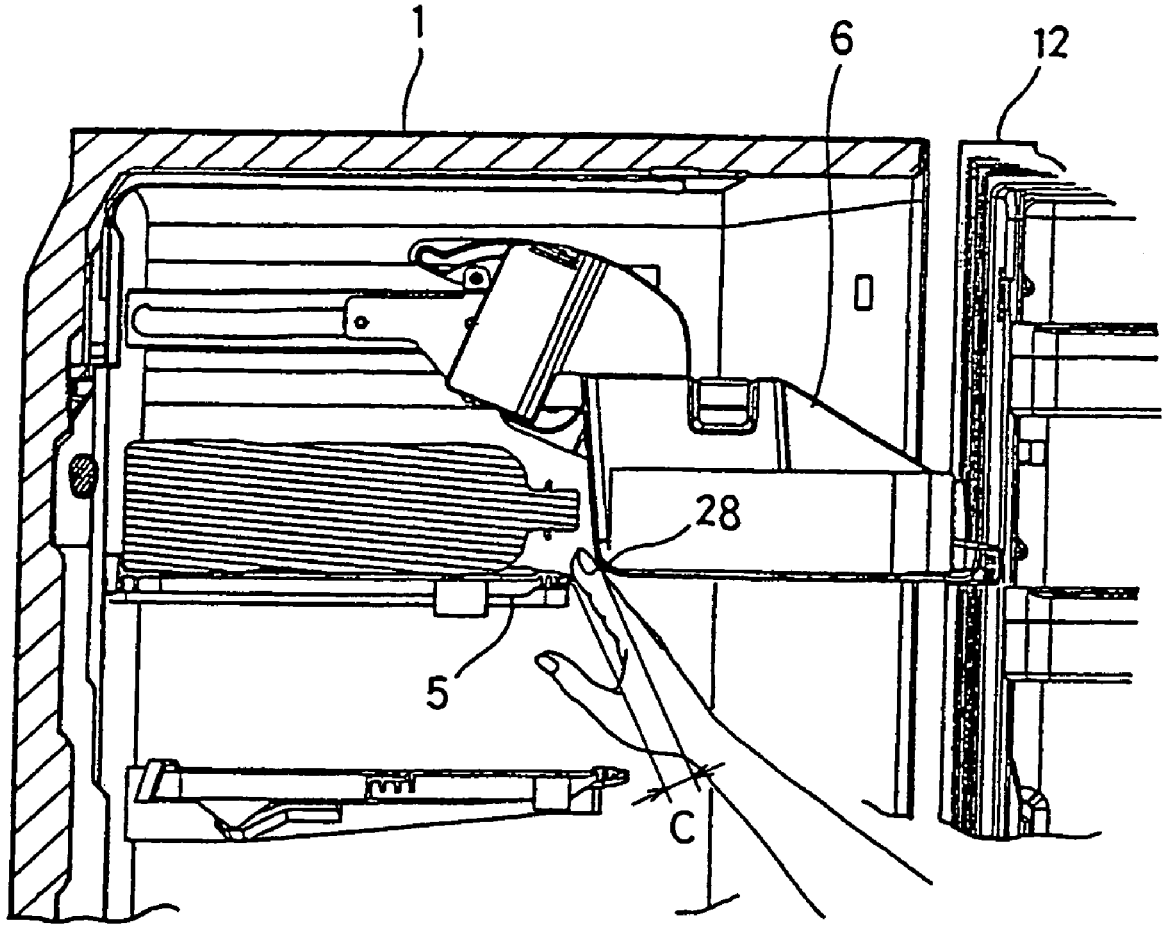
FIG. 18 is a side sectional view showing a relationship between a downward adjacent shelf and the rack container at downwardly shifted state.
Figure 19:
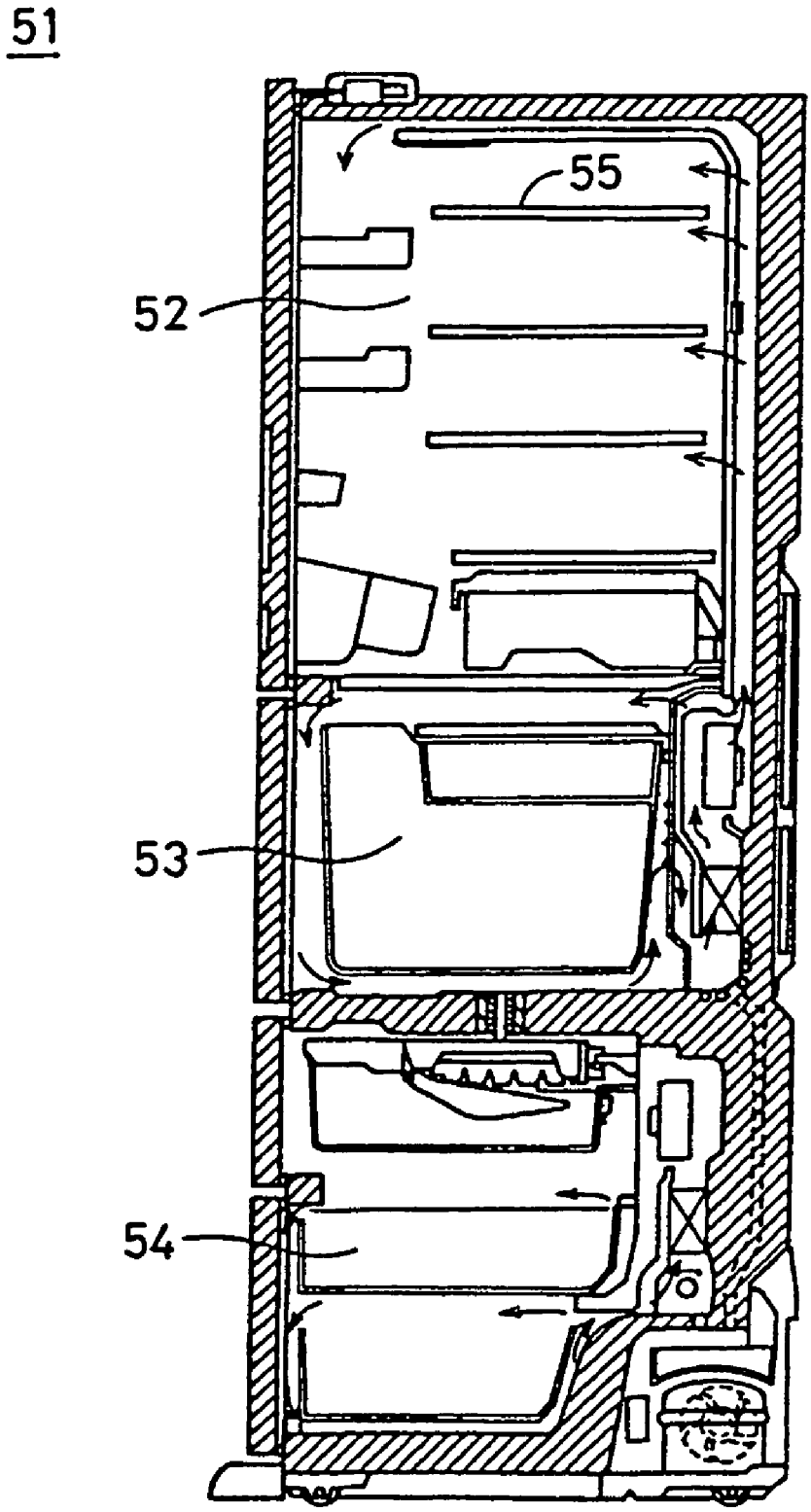
FIG. 19 is a vertical sectional view of a refrigerator commonly used.

As in FIG. 18, when the rack container (6) is in its lowermost position, the rack container (6) is distanced from front face of the downward adjacent shelf (5) by a clearance C of about 15 to 25 mm. Such clearance C not only prevents interference between the rear ridge of the rack container (6) and the front face of the downward adjacent shelf (5) but also prevents occasions where fingers of the hand, which grabs the downward adjacent shelf (5) for supporting or which grabs the rear ridge of the rack container (6), are pinched between the rack container (6) that moves downward and the downward adjacent shelf (5). As a way for forming the clearance C, chamfering or rounding face (28) may be made at bottom portion of rear wall of the rack container (6).

When to return the rack container (6) back to upper position, conversely with the pulling down procedure, the front face portion of the rack container (6) is grabbed and heaved slantly upward. Then, the rack container (6) is lifted with small force, assisted with force by the spiral spring (20) and facilitated by arrangement of the hinged portions (9) (10) and the working points (9*a*) (10*a*) as well as the clearance C. On way of upward shifting, the protrusion (17*c*) of the stopper (17) engages with the front face of the stationary rail (7), and thereby backward shifting of the traveling rail (8) is prevented; thus, contact with the items on the downward adjacent shelf being avoided.

When the rack container (6) has been lifted, the protrusion (17*c*) comes out of engagement with the stationary rail (7), and thus, the traveling rail (8) become slidable backward as to place the rack container (6) in its rearmost retracted position.

On occasion of such returning and pulling out of the rack container (6), in view of that the rack mechanism is formed of a plurality of elements that are movable to each other, it might arise lopsidedness or staggering between right-hand side and left-hand side. Nevertheless, rear arms (10) on right-hand and left-hand sides, which directly involve holding of the rack container (6), are connected by the rear frame (22) as to relieve such lopsidedness or staggering within a whole of rack mechanism as an assembled body; thereby smooth shifting of the rack container (6) being facilitated.

On applying the inventive rack apparatuses in household refrigerators, the rack container is not necessarily on entire inner width of the storage compartment of chamber. Partition may be made in width-wise direction with vertical partitioner or partitioners; and the rack mechanism may be disposed in each partition such that the rack container in the each partition is respectively shiftable up-downwardly.

In heretofore explanation, a rack in a refrigerator is exemplified; however, the inventive apparatus may be adopted as a sliding shelf for kitchen wares or other vessels, or as a rack construction for other kitchen cabinet or warehouse, as a matter of course. Further, the rack container may be other than vessel form and may be plate form that is similar with the downward adjacent shelves. Position for disposing the inventive rack mechanism may be other than the uppermost.

As explained hereto, followings are accomplished by the invention with respect to a rack apparatus and a refrigerator equipped thereof: a rack construction shiftable horizontally and upward and downward in a reliable manner with simple procedure; and a refrigerator having such rack construction; as well as, improved user friendliness and easiness in taking the items into and from the rack construction even if it is at quite a height under normal state; and efficient usage of the internal space of the storage compartment or receiving part.

CROSS-REFERENCE TO RELATED APPLICATIONS

This application is based upon and claims the benefits of priority from the prior Japanese Patent Applications No. 2002-12479 filed on Apr. 25, 2002, No. 2002-214431 filed on Jul. 23, 2002 and No. 2002-248459 filed on Aug. 28, 2002; the contents of which are incorporated herein by reference.

What is claimed is:

1. A rack apparatus comprising:

stationary rails attached on side walls of receiving space;

traveling rails horizontally sliding on the stationary rails;

a fore arm and a rear arm hinged on each of the traveling rails as to turn around one way or other;

a stopper having an arc-shaped linkage groove and being hinged on each traveling rail as to be freely turnable about a hinged portion;

a protrusion formed on the stopper in vicinity of such hinged portion, the protrusion being engaged with the respective stationary rail to block downward turning of the stopper during sliding on the stationary rails and then leaving out from an end of the stationary rail to allow downward turning of the stopper;

a guide pin protruding from the rear arm to engage with the linkage groove, and being shifted to a lowermost position of the linkage groove to allow downward turn-wise shifting of a distal end of the rear arm in accordance with downward turning of the stopper;

a rack support connecting the fore and rear arms; and a rack container supported on the rack supports, said rack container being able to be shifted forward by the traveling rails and then be shifted downward and upward with keeping its horizontal posture, by turning of the fore and rear arms.

2. A rack apparatus according to claim 1, wherein the fore and rear arms have hinged portions at underside base portions and hold the respective rack support and the rack container at upside distal portions of the fore and rear arms, so as to be downwardly turnable about the hinged portions.

3. A refrigerator in combination with the rack apparatus according to claim 2, wherein the rack apparatus is located at an uppermost rack opening in a storage compartment or chamber of the refrigerator.

4. A rack apparatus according to claim 2, further comprising a spring at the hinged portion as to exert spring force for facilitating upward and backward turning of the fore and rear arms.

5. A rack apparatus according to claim 4, further comprising a damper on an outer face of the rear arm for abutting on the respective traveling rail in accordance with turning motion of the rear arm as to stop downward shifting of the rack container, wherein a spring force of said spring being smaller than a shock-absorbing force of said damper.

6. A refrigerator in combination with the rack apparatus according to claim 5, wherein the rack apparatus is located at an uppermost rack opening in a storage compartment or chamber of the refrigerator.

7. A refrigerator in combination with the rack apparatus according to claim 4, wherein the rack apparatus is located at an uppermost rack opening in a storage compartment or chamber of the refrigerator.

8. A rack apparatus according to claim 1, wherein the fore and rear arms are hinged on a base-part surface of the respective traveling rail at spaced-apart positions and as to be freely turnable, distal ends of the fore and rear arms are hinged on the respective rack support at two neighboring positions respectively and are thereby connected with each other.

9. A refrigerator in combination with the rack apparatus according to claim 8, wherein the rack apparatus is located at an uppermost rack opening in a storage compartment or chamber of the refrigerator.

10. A rack apparatus according to claim 1, wherein the rack container is held on a supporting portion of the rack supports by use of a rack fastener in a manner as detachable and re-attachable.

11. A rack apparatus according to claim 10, the rack fastener being engaged on a latching portion of the rack supports as turnable in one way or the other, and the rack fastener being latched on the rack container by way of engagement between a protrusion and a recess or hole, in a manner that the rack container is detachable and re-attachable onto the rack supports.

12. A refrigerator in combination with the rack apparatus according to claim 11, wherein the rack apparatus is located at an uppermost rack opening in a storage compartment or chamber of the refrigerator.

13. A refrigerator in combination with the rack apparatus according to claim 10, wherein the rack apparatus is located at an uppermost rack opening in a storage compartment or chamber of the refrigerator.

14. A rack apparatus according to claim 1, further comprising a reinforcing frame that is secured on the rack supports on right-hand and left-hand sides and thrusts forward as to engage with and receive a front fringe of the rack container.

15. A refrigerator in combination with the rack apparatus according to claim 14, wherein the rack apparatus is located at an uppermost rack opening in a storage compartment or chamber of the refrigerator.

16. A rack apparatus according to claim 1, further comprising a rear frame that connects the rear arms on right and left sides and is disposed to be at a backside of the rack container at its rear-upside retracted position.

17. A refrigerator in combination with the rack apparatus according to claim 16, wherein the rack apparatus is located at an uppermost rack opening in a storage compartment or chamber of the refrigerator.

18. A rack apparatus according to claim 1, further comprising a rack opening's guard at an opening of the rack container; and a guard part of the rack opening's guard being shiftable between a position at upside of the rack container and a position at foreside of the rack container.

19. A refrigerator in combination with the rack apparatus according to claim 18, wherein the rack apparatus is located at an uppermost rack opening in a storage compartment or chamber of the refrigerator.

20. A rack apparatus according to claim 1, wherein a front face of the rack container is formed as rounded to bulge out from its center portion.

21. A rack apparatus according to claim 1, wherein the rack container is disposed in a storage compartment or chamber of a refrigerator and is to be shifted forward and then downward so as to be kept at such downward shifted position; and at the downward shifted position, a bottom face of the rack container is at a height of 140 to 155 cm from a floor surface on which a main body of the refrigerator stands.

22. A refrigerator in combination with the rack apparatus according to claim 21, wherein the rack apparatus is located at an uppermost rack opening in a storage compartment or chamber of the refrigerator.

23. A rack apparatus according to claim 1, wherein the rack container is disposed in a storage compartment or chamber of a refrigerator and is to be shifted forward and then downward so as to be kept at such downward shifted position; and at the downward shifted position, a rear part of the rack container being forwardly distanced from a fore end of a downward adjacent shelf to form a certain clearance for avoiding interference between the rack container and the shelf.

24. A refrigerator in combination with the rack apparatus according to claim 23, wherein the rack apparatus is located at an uppermost rack opening in a storage compartment or chamber of the refrigerator.

25. A refrigerator in combination with the rack apparatus according to claim 1, wherein the rack apparatus is located at an uppermost rack opening in a storage compartment or chamber of the refrigerator.

* * * * *